US008323009B2

(12) United States Patent
Shimizu et al.

(10) Patent No.: US 8,323,009 B2
(45) Date of Patent: Dec. 4, 2012

(54) ROTARY-TYPE FLUID MACHINE

(75) Inventors: Takashi Shimizu, Sakai (JP); Yoshitaka Shibamoto, Sakai (JP); Takazou Sotojima, Sakai (JP); Masanori Masuda, Sakai (JP)

(73) Assignee: Daikin Industries, Ltd., Osaka (JP)

( * ) Notice: Subject to any disclaimer, the term of this patent is extended or adjusted under 35 U.S.C. 154(b) by 264 days.

(21) Appl. No.: 12/864,383

(22) PCT Filed: Jan. 23, 2009

(86) PCT No.: PCT/JP2009/000267

§ 371 (c)(1),
(2), (4) Date: Jul. 23, 2010

(87) PCT Pub. No.: WO2009/093470

PCT Pub. Date: Jul. 30, 2009

(65) Prior Publication Data

US 2010/0296959 A1 Nov. 25, 2010

(30) Foreign Application Priority Data

Jan. 24, 2008 (JP) ..... 2008-013670

(51) Int. Cl.
*F03C 2/00* (2006.01)
*F04C 18/00* (2006.01)
*F04C 2/00* (2006.01)

(52) U.S. Cl. ..... 418/59; 418/11; 418/60; 418/212

(58) Field of Classification Search ..... 418/11, 418/15, 59, 60, 63, 94, 212, 248, 221; 417/313, 417/410.3

See application file for complete search history.

(56) References Cited

U.S. PATENT DOCUMENTS

| | | | | | |
|---|---|---|---|---|---|
| 2,218,573 | A | * | 10/1940 | Gahm | 91/21 |
| 3,782,865 | A | * | 1/1974 | Braun | 418/59 |
| 4,086,042 | A | * | 4/1978 | Young | 418/139 |
| 4,345,886 | A | * | 8/1982 | Nakayama et al. | 418/248 |
| 5,006,051 | A | * | 4/1991 | Hattori | 418/60 |
| 5,399,076 | A | * | 3/1995 | Matsuda et al. | 418/59 |
| 2002/0131882 | A1 | | 9/2002 | Kimura et al. | |
| 2008/0240958 | A1 | | 10/2008 | Masuda | |

FOREIGN PATENT DOCUMENTS

JP 57176385 A * 10/1982

(Continued)

OTHER PUBLICATIONS

Notice of Reasons for Rejection of corresponding Japanese Application No. 2009-013241 dated Feb. 24, 2009.

*Primary Examiner* — Theresa Trieu
(74) *Attorney, Agent, or Firm* — Global IP Counselors

(57) ABSTRACT

A rotary-type fluid machine includes a compression mechanism having piston mechanisms arranged one on top of the other and a drive mechanism having a drive shaft that is configured and arranged to drive the piston mechanisms. Each of the two piston mechanisms includes a cylinder member with a cylinder chamber, a piston member housed eccentrically in the cylinder chamber such that the cylinder chamber is partitioned into first and second compression chambers. A phase difference of 90 degrees in volume change is made between the cylinder chambers of the two piston mechanisms. A movable one of the cylinder and piston has a first surface facing one of the first cylinder chambers and a second surface facing one of the second cylinder chambers, with a surface area of the first surface being equal to a surface area of the second surface.

4 Claims, 11 Drawing Sheets

FOREIGN PATENT DOCUMENTS

| | | | |
|---|---|---|---|
| JP | 59-145389 | A | 8/1984 |
| JP | 62-102801 | U | 6/1987 |
| JP | 3-279692 | A | 12/1991 |
| JP | 5-280480 | A | 10/1993 |
| JP | 2002-106480 | A | 4/2002 |
| JP | 2002-266777 | A | 9/2002 |
| JP | 2005-320929 | A | 11/2005 |
| JP | 3757977 | B | 1/2006 |

* cited by examiner (A)

(B)

(A)

(B)

ROTARY-TYPE FLUID MACHINE

CROSS-REFERENCE TO RELATED APPLICATIONS

This U.S. National stage application claims priority under 35 U.S.C. §119(a) to Japanese Patent Application No. 2008-013670, filed in Japan on Jan. 24, 2008, the entire contents of which are hereby incorporated herein by reference.

TECHNICAL FIELD

The present invention relates to a rotary-type fluid machine, and particularly to a rotary-type fluid machine including two eccentric-rotation type piston mechanisms arranged one on top of the other, the eccentric-rotation type piston mechanisms each having a cylinder formed with a cylinder chamber and a piston housed eccentrically in the cylinder chamber.

BACKGROUND ART

Conventionally, a rotary-type fluid machine is known which includes an eccentric-rotation type piston mechanism having a cylinder formed with a cylinder chamber and a piston housed eccentrically in the cylinder chamber. In the rotary-type fluid machine, one of the cylinder and the piston is formed as a fixed member and the other thereof is formed as a moving member attached eccentrically to a drive shaft, and the drive shaft is rotated to thereby rotate the moving member eccentrically to the fixed member.

In the rotary-type fluid machine, the drive shaft rotates while undergoing a periodic variation in the output torque thereof, and the variation in the output torque may cause a vibration or a noise in the rotary-type fluid machine.

Japanese Patent No. 3757977 discloses a rotary-type fluid machine capable of suppressing a variation in the output torque thereof. The rotary-type fluid machine is configured as a rotary compressor and includes two eccentric-rotation type piston mechanisms arranged vertically in tiers, each having two compression chambers on the same plane.

Specifically, an eccentric-rotation type piston mechanism (60) described above is formed, as shown in FIG. 12, with a compression chamber (C1, C2) and a piston (61) each having a ring shape. The ring-shaped piston (61) is housed eccentrically in the ring-shaped compression chamber (C1, C2) of a cylinder (62) such that the compression chamber (C1, C2) is partitioned into an outside compression chamber (C1) and an inside compression chamber (C2). The cylinder (62) is provided with a blade (63) partitioning each of the outside compression chamber (C1) and the inside compression chamber (C2) into a high-pressure side (Hp) and a low-pressure side (Lp). The cylinder (62) as a moving member is rotated eccentrically to the ring-shaped piston (61) as a fixed member.

Here, the piston (61) is housed in a cylinder chamber (C1, C2, C3, C4) such that as the cylinder (62) is eccentrically rotated, a phase difference of 180 degrees in volume change is made between the outside compression chamber (C1) and the inside compression chamber (C2).

FIG. 13 is a graphical representation showing how a variation in the rotation angle of a drive shaft affects the output torque of the drive shaft. In the figure, a line A indicates a variation in the total output torque of the drive shaft by the outside compression chamber (C1) and the inside compression chamber (C2), a line B indicates a variation in the output torque of the drive shaft by the outside compression chamber (C1, C3) and a line C indicates a variation in the output torque of the drive shaft by the inside compression chamber (C2, C4).

The phase difference in volume change between the outside compression chamber (C1) and the inside compression chamber (C2) is shifted by 180 degrees, and thereby, the peak values of the output torque of the drive shaft by each compression chamber (C1, C2) are also shifted by 180 degrees. Therefore, the eccentric-rotation type piston mechanism (60) generates output-torque variations (the lines B and C of FIG. 13) where the peak values by each compression chamber (C1, C2) alternately appear at intervals of 180 degrees.

Then, the output-torque variations by each compression chamber (C1, C2) affect each other, and thereby, the eccentric-rotation type piston mechanism (60) is capable of generating the total output torque of the drive shaft shown by the line A of FIG. 13 and suppressing a variation in the output torque of the drive shaft.

In the rotary compressor according to Japanese Patent No. 3757977, the two eccentric-rotation type piston mechanisms capable of suppressing an output-torque variation in this manner are arranged vertically in tiers, and a phase difference of 90 degrees in volume change is made between the cylinder chambers (C1, C2, C3, C4) of both eccentric-rotation type piston mechanisms (20). Specifically, the eccentricity directions of the rotation axes of both cylinders fixed to the drive shaft mutually have an angle difference of 90 degrees to the axial center of the drive shaft.

Similarly to FIG. 13, FIG. 14 is a graphical representation showing how a variation in the rotation angle of a drive shaft affects the output torque of the drive shaft. In the figure, a line B indicates a variation in the output torque of the drive shaft in the case of only the upper eccentric-rotation type piston mechanism (20), a line C indicates a variation in the output torque of the drive shaft in the case of only the lower eccentric-rotation type piston mechanism (20) and a line A indicates a variation in the output torque of the drive shaft in the case where the upper and lower eccentric-rotation type piston mechanisms (20) are joined together.

The rotational phases of both eccentric-rotation type piston mechanisms (20) are mutually shifted by 90 degrees, and thereby, the peak values of the output torque of the drive shaft by each eccentric-rotation type piston mechanism (20) are also shifted by 90 degrees. Therefore, the rotary compressor according to Japanese Patent No. 3757977 generates output-torque variations (the lines B and C of FIG. 14) where peak values (P1, P2, P3, P4) by each compression chamber (C1, C2) of each eccentric-rotation type piston mechanism (20) appear at intervals of 90 degrees.

Specifically, the peak value (P1) by the inside compression chamber (C2) of the upper eccentric-rotation type piston mechanism (20), the peak value (P3) by the inside compression chamber (C2) of the lower eccentric-rotation type piston mechanism (20), the peak value (P2) by the outside compression chamber (C1) of the upper eccentric-rotation type piston mechanism (20) and the peak value (P4) by the outside compression chamber (C1) of the lower eccentric-rotation type piston mechanism (20) appear at intervals of 90 degrees in this order.

Then, the output-torque variations by the two eccentric-rotation type piston mechanisms (20) affect each other, and thereby, the rotary compressor is capable of generating the total output torque of the drive shaft shown by the line A of FIG. 14 and further suppressing a variation in the output torque of the drive shaft.

SUMMARY

Technical Problem

However, in the rotary compressor according to PATENT DOCUMENT 1 (hereinafter, referred to as the conventional rotary compressor), in order to reduce the vibration or noise thereof, the variation in the output torque of the drive shaft is desired to be further narrowed.

In view of the problem, it is an object of the present invention to provide a rotary-type fluid machine which includes two eccentric-rotation type piston mechanisms arranged one on top of the other, the eccentric-rotation type piston mechanisms each having a cylinder formed with a cylinder chamber and a ring-shaped piston housed eccentrically in the cylinder chamber, and which is capable of suppressing a variation in the output torque of a drive shaft and thereby reducing the vibration or noise of this rotary compressor.

Solution to the Problem

A rotary-type fluid machine according to a first aspect of the present invention includes: a compression mechanism (5) including two eccentric-rotation type piston mechanisms (20) arranged one on top of the other; and a drive mechanism (30) including a drive shaft (33) for driving both two eccentric-rotation type piston mechanisms (20), in which the eccentric-rotation type piston mechanism (20) includes a cylinder member (21) formed with a cylinder chamber (C1, C2, C3, C4), a piston member (22) housed eccentrically in the cylinder chamber (C1, C2, C3, C4) such that the cylinder chamber (C1, C2, C3, C4) is partitioned into a first cylinder chamber (C1, C3) and a second cylinder chamber (C2, C4), and a blade member (23) partitioning each of the first cylinder chamber (C1, C3) and the second cylinder chamber (C2, C4) into a high-pressure side and a low-pressure side, one of the cylinder member (21) and the piston member (22) is formed as a fixed member and the other thereof is formed as a moving member making an eccentric rotational motion to the fixed member, and as the moving member makes the eccentric rotational motion, a phase difference of 180 degrees in volume change is made between the first cylinder chamber (C1, C3) and the second cylinder chamber (C2, C4) and a phase difference of 90 degrees in volume change is made between the cylinder chambers (C1, C2, C3, C4) of both eccentric-rotation type piston mechanisms (20).

Then, in the above rotary-type fluid machine, the moving member has a first surface (25) facing on the first cylinder chamber (C1, C3) and a second surface (26) facing on the second cylinder chamber (C2, C4), and the surface area of the first surface (25) is equalized to the surface area of the second surface (26). Particularly, it is preferable that the surface area of the first surface (25) in the circumferential directions is equalized to the surface area of the second surface (26) in the circumferential directions.

According to the first aspect, the first surface (25) and the second surface (26) of each moving member attached to the drive shaft (33) have the same surface area. Therefore, a load exerted on the moving member (a load working on the first surface (25)) by the gas pressure inside of the first cylinder chamber (C1, C3) can be equalized to a load exerted on the moving member (a load working on the second surface (26)) by the gas pressure inside of the second cylinder chamber (C2, C4).

Here, the output torque of the drive shaft (33) is determined by the load working on the moving member. Accordingly, the load working on the first surface (25) is equalized to the load working on the second surface (26), and thereby, the variations in the output torque of the drive shaft (33) by each eccentric-rotation type piston mechanism (20) can be equalized. Therefore, the peak values (P1, P2, P3, P4) of the variations in the output torque by each eccentric-rotation type piston mechanism (20) can also be equalized.

According to a second aspect of the present invention, in the rotary-type fluid machine according to the first aspect, the cylinder chamber (C1, C2, C3, C4) has a ring shape, and the piston member (22) is formed by a ring-shaped piston (22) housed eccentrically in the ring-shaped cylinder chamber (C1, C2, C3, C4) such that the cylinder chamber (C1, C2, C3, C4) is partitioned into an outside cylinder chamber (C1, C3) and an inside cylinder chamber (C2, C4). Then, the first cylinder chamber (C1, C3) is formed by the outside cylinder chamber (C1, C3) and the second cylinder chamber (C2, C4) is formed by the inside cylinder chamber (C2, C4).

In the rotary-type fluid machine according to the second aspect, for example, as shown in FIG. 2, even if the eccentric-rotation type piston mechanism (20) is formed with the ring-shaped piston and cylinder chambers, the same advantages as the first aspect can be obtained. In the eccentric-rotation type piston mechanism (20) of FIG. 2, the ring-shaped piston (22) is the moving member, and the outer and inner circumferential surfaces of a piston portion (22*a*) of the ring-shaped piston (22) correspond to the first and second surfaces, respectively.

In order to equalize the surface areas of the outer and inner circumferential surfaces, these surfaces are designed to differ in the height of each wall surface thereof in the axial directions. Specifically, the outer circumferential surface is longer in the circumferential directions than the inner circumferential surface, and hence, the outer circumferential surface is set to be lower in the axial directions than the inner circumferential surface to thereby equalize the surface areas of both surfaces.

According to a third aspect of the present invention, in the rotary-type fluid machine according to the second aspect, the ring-shaped piston (22) is formed with a straight portion (22*d*) arranged at a part thereof in the circumferential directions and continuing to the other parts thereof, and the cylinder member (21) is foamed with a groove portion (28) perpendicular to the straight portion (22*d*) and striding across the outside cylinder chamber (C1, C3) and the inside cylinder chamber (C2, C4). Then, the blade member (23) includes: an outside blade portion (23*a*) partitioning the outside cylinder chamber (C1, C3), an inside blade portion (23*b*) united with the outside blade portion (23*a*) and partitioning the inside cylinder chamber (C2, C4), and a concave portion (23*c*) formed between the outside blade portion (23*a*) and the inside blade portion (23*b*) and fitted slidably with the straight portion (22*d*) of the ring-shaped piston (22); and is formed by a concave blade (23) fitted slidably into the groove portion (28).

According to the third aspect, the blade member (23) prevents the ring-shaped piston (22) of the rotary-type fluid machine according to the second aspect from rotating on the axis thereof. Specifically, the ring-shaped piston (22) slides perpendicularly to the blade member (23) arranged in radial directions thereof and moves together with the blade member (23) only in the radial directions. Therefore, the ring-shaped piston (22) is restrained from being displaced in the rotational directions, and hence, the blade member (23) prevents the ring-shaped piston (22) from rotating on the axis thereof.

A rotary-type fluid machine according to a fourth aspect of the present invention includes: a compression mechanism (95) including two eccentric-rotation type piston mechanisms (100) arranged one on top of the other; and a drive mechanism (30) including a drive shaft (33) for driving both eccentric-rotation type piston mechanisms (100), in which the eccentric-rotation type piston mechanism (100) includes a cylinder (103) formed with a cylinder chamber (101, 102), a piston (104) housed in the cylinder chamber (101, 102) such that the piston (104) is eccentric to the cylinder chamber (101, 102), and a plurality of vanes (105, 107) partitioning the cylinder chamber (101, 102) into a first cylinder chamber (101) and a second cylinder chamber (102), and the piston (104) provides an eccentric rotational motion to the cylinder (103). Then, a phase difference of 90 degrees in volume change is made between the cylinder chambers (101, 102) of both eccentric-rotation type piston mechanisms (100). Further, the pistons (104) of both eccentric-rotation type piston mechanisms (100) each have a first surface (114) facing on the first cylinder chamber (101) and a second surface (115) facing on the second cylinder chamber (102), and the surface area of the first surface (114) is equalized to the surface area of the second surface (115).

According to the fourth aspect, the first surface (114) and the second surface (115) of each piston (104) attached to the drive shaft (33) have the same surface area. Therefore, a load exerted on the first surface (114) by the gas pressure inside of the first cylinder chamber (101) can be equalized to a load exerted on the second surface (115) by the gas pressure inside of the second cylinder chamber (102). This makes it possible to obtain the same advantages as the first aspect.

Advantages of the Invention

In the rotary-type fluid machine according to the present invention, the first surface (25) and the second surface (26) of each moving member have the same surface area, and thereby, the peak values (P1, P2, P3, P4) of variations in the output torque of the drive shaft (33) by each eccentric-rotation type piston mechanism (20) can be equalized. Therefore, the rotary-type fluid machine is capable of generating an output torque of a drive shaft shown by a line A of FIG. 8 and making the variation in the output torque narrower than that in the output torque (the line A of FIG. 14) of the conventional rotary-type fluid machine. As a result, the vibration or noise of the rotary-type fluid machine can be reduced.

Furthermore, in the rotary-type fluid machine according to the second aspect, as shown in FIG. 2, even if the eccentric-rotation type piston mechanism (20) is formed with the ring-shaped piston and cylinder chambers, the same advantages as the first aspect can be obtained.

Moreover, in the rotary-type fluid machine according to the third aspect, the blade member (23) prevents the ring-shaped piston (22) from rotating on the axis thereof. Therefore, a member such as an Oldham coupling employed as a rotation prevention mechanism can be spared, thereby reducing the production cost of the rotary-type fluid machine.

In addition, in the rotary-type fluid machine according to the fourth aspect, the first surface (114) and the second surface (115) of each piston (104) have the same surface area, and thereby, the same advantages as the first aspect can be obtained. Therefore, the variation in the output torque becomes narrower than that in the output torque (the line A of FIG. 14) of the conventional rotary-type fluid machine, thereby reducing the vibration or noise of the rotary-type fluid machine according to the fourth aspect.

DESCRIPTION OF EMBODIMENTS

Embodiments of the present invention will be below described in detail with reference to the drawings.

First Embodiment

Figure 1:
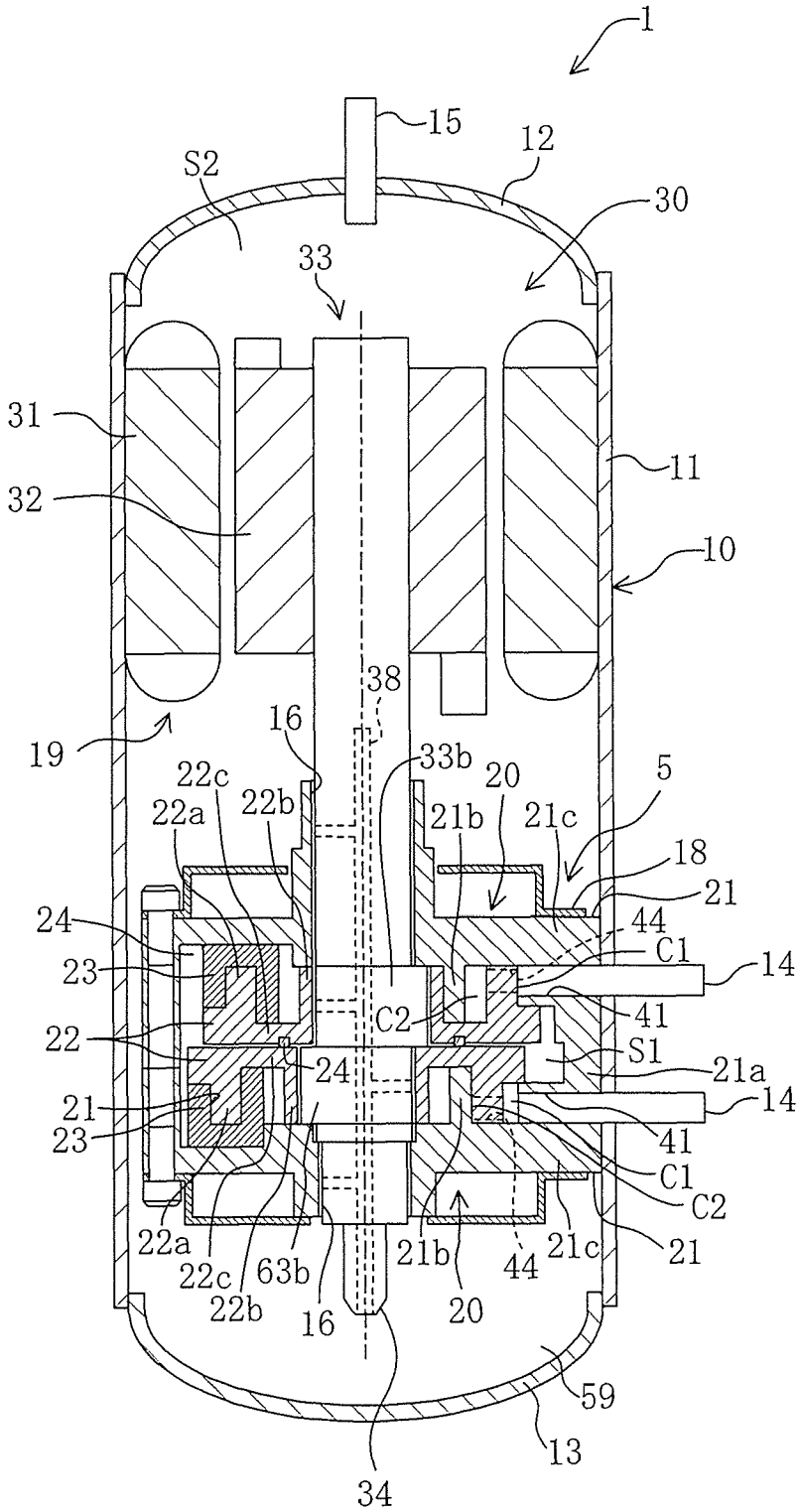
FIG. 1 is a longitudinal sectional view of a rotary compressor according to a first embodiment of the present invention.

As shown in FIG. 1, a rotary-type fluid machine according to a first embodiment of the present invention is a fully-closed rotary compressor (1) including an electric motor (drive mechanism) (30) and a compression mechanism (5) housed in a casing (10). The rotary compressor (1) is provided, for example, in a refrigerant circuit of an air conditioner and is used for compressing a gas refrigerant sucked from an evaporator and discharging it to a condenser.

The casing (10) is a closed container formed by a vertically-long cylindrical body portion (11), an upper end plate (12) fixed to an upper-end part of the body portion (11) and a lower end plate (13) fixed to a lower-end part of the body portion (11). The upper end plate (12) is provided with a discharge pipe (15) penetrating the upper end plate (12). The discharge pipe (15) leads into the casing (10), and the inlet thereof opens in the space over the electric motor (30) arranged above inside of the casing (10). Further, the body portion (11) is provided with two suction pipes (14) penetrating the body portion (11). The suction pipes (14) are each connected to the compression mechanism (5) arranged below inside of the casing (10).

The rotary compressor (1) is configured to discharge a refrigerant compressed in the compression mechanism (5) to an inner portion (S2) of the casing (10) and thereafter send it out of the casing (10) through the discharge pipe (15). Therefore, when the rotary compressor (1) is in operation, the inside of the casing (10) is a high-pressure space (S2).

The electric motor (30) includes a stator (31) and a rotor (32). The stator (31) is cylindrical and fixed to the inner surface of the body portion (11) of the casing (10), and the rotor (32) is provided with a drive shaft (33) connected thereto such that the drive shaft (33) rotates together with the rotor (32).

The drive shaft (33) is formed inside with an oil supply passage (38) extending from the lower-end surface of the drive shaft (33) to the peripheral surface thereof. The drive shaft (33) is also provided at the lower end with an oil pump (34) supplying a lubricating oil inside of a storage portion (59) formed in a bottom part of the casing (10) through the oil supply passage (38) to each sliding parts of the compression mechanism (5) and a sliding surface formed between ring-shaped pistons (22) (described later) provided back to back with each other.

The drive shaft (33) is formed at a lower part with upper and lower adjacent eccentric portions (33*b*, 63*b*) shown in FIG. 1. The eccentric portions (33*b*, 63*b*) have a larger diameter than the part of the drive shaft (33) over and under the eccentric portions (33*b*, 63*b*), respectively. The axial centers of the eccentric portions (33*b*, 63*b*) are eccentric to the axial center of the drive shaft (33), and the eccentricity directions thereof mutually have an angle difference of 90 degrees.

The compression mechanism (5) includes two compression portions (eccentric-rotation type piston mechanisms) (20, 20). The compression portions (20, 20) each have substantially the same configuration, except that the axial centers of the eccentric portions (33*b*, 63*b*) are eccentric, and the compression portions (20, 20) are vertically adjacent to each other.

Figure 2:
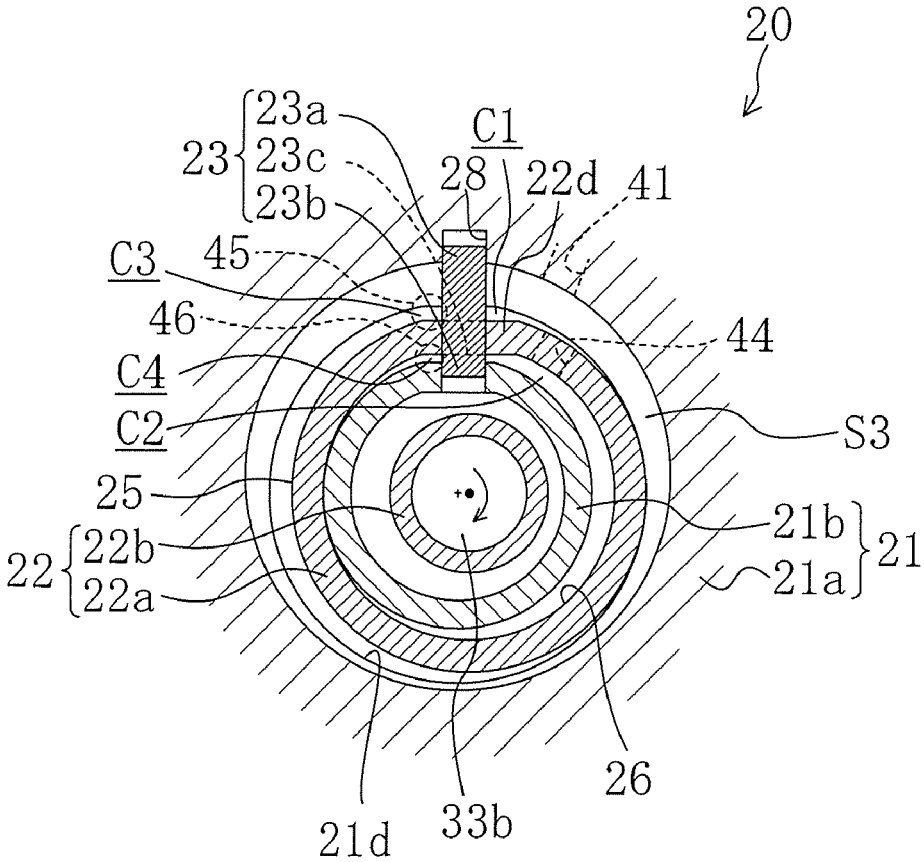
FIG. 2 is a transverse sectional view of a compression portion of the rotary compressor according to the first embodiment.

FIG. 2 is a transverse sectional view of the compression portion (20). The upper and lower compression portions (20, 20) each include, as shown in FIG. 2: a cylinder (21) having a ring-shaped compression chamber (C1, C2, C3, C4); the ring-shaped piston (22) housed eccentrically in the ring-shaped compression chamber (C1, C2, C3, C4) such that the ring-shaped compression chamber (C1, C2, C3, C4) is partitioned into an outside compression chamber (C1, C3) and an inside compression chamber (C2, C4); and a blade (23) partitioning each of the outside compression chamber (C1, C3) and the inside compression chamber (C2, C4) into a high-pressure side and a low-pressure side. Then, in each compression portion (20, 20), the ring-shaped piston (22) makes an eccentric rotational motion to the cylinder (21) inside of the ring-shaped compression chamber (C1, C2, C3, C4). In other words, the ring-shaped piston (22) is formed as a moving member and the cylinder (21) is formed as a fixed member.

Figure 4:
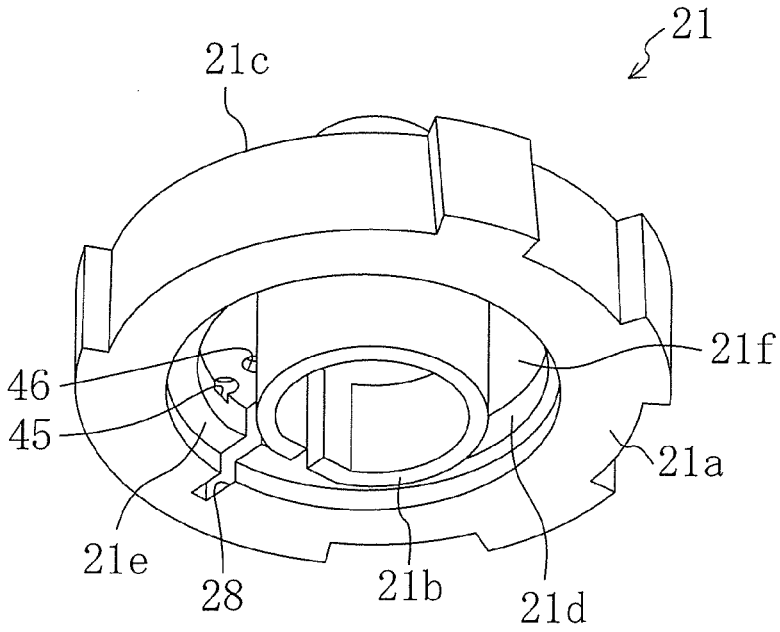
FIG. 4(A) is a perspective view of a cylinder according to the first embodiment.
FIG. 4(B) is a plan view of the cylinder.
Figure 4:
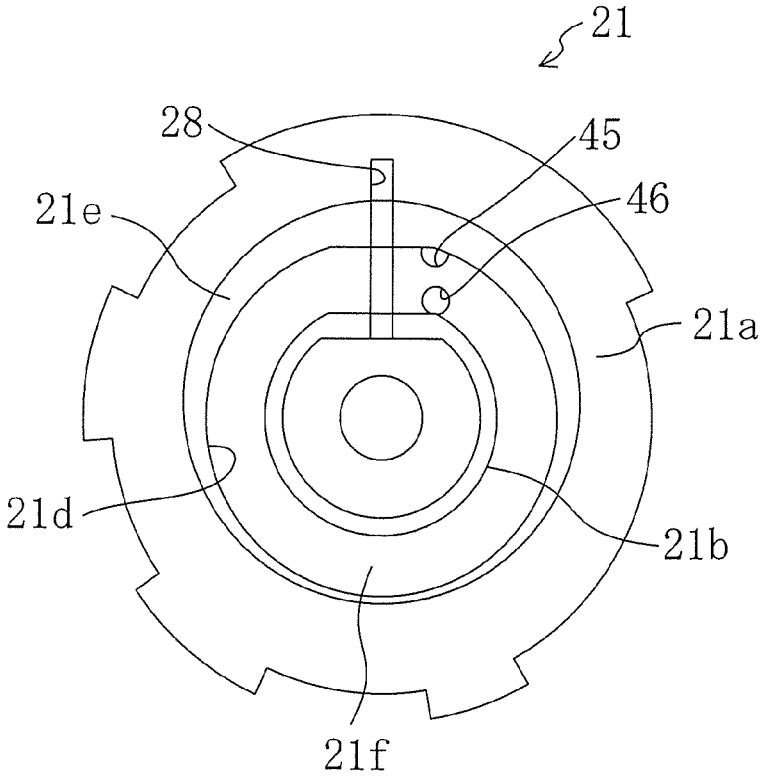

The upper and lower cylinders (21, 21) each include, as shown in FIGS. 1, 2 and 4, an outside cylinder portion (21*a*), an inside cylinder portion (21*b*) and a cylinder-side end plate (21*c*). Each cylinder (21) is formed by connecting an end part of the outside cylinder portion (21*a*) and an end part of the inside cylinder portion (21*b*) by the cylinder-side end plate (21*c*). Both cylinders (21, 21) are penetrated at a central part thereof by the drive shaft (33), and on the inner circumferential surfaces of the through holes thereof which the drive shaft (33) penetrates through, are each provided with a sliding bearing (16) supporting the drive shaft (33) such that the drive shaft (33) is rotatable.

In the upper and lower cylinders (21, 21), the end surfaces of the outside cylinder portions (21*a*) of both cylinders (21, 21) are adherently fixed to each other to thereby form an inner space (S1) between the cylinders (21, 21). Then, the outer circumferential surfaces of the thus fixed cylinders (21, 21) are fixed to the inner circumferential surface of the casing (10) by welding or the like. In the inner space (51), the two ring-shaped pistons (22, 22) are housed.

Figure 3:
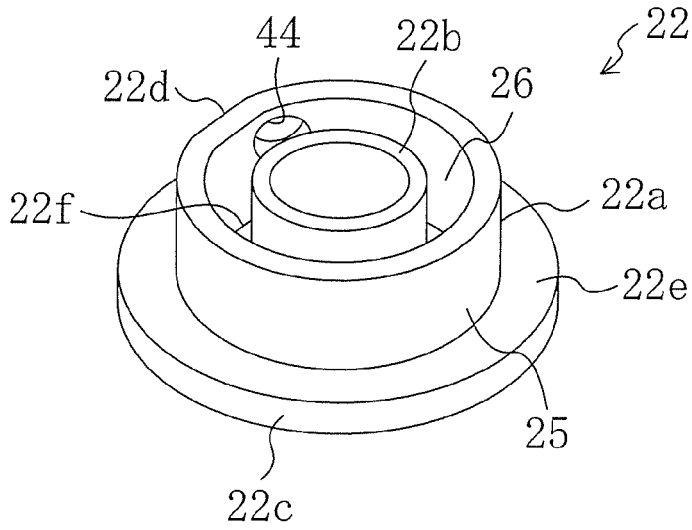
FIG. 3(A) is a perspective view of a ring-shaped piston according to the first embodiment.
FIG. 3(B) is a plan view of the ring-shaped piston.
Figure 3:
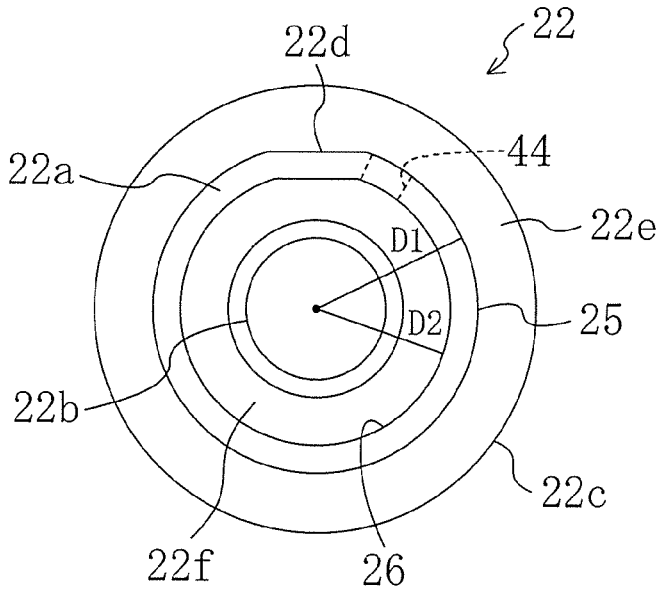

As shown in FIG. 1, the two ring-shaped pistons (22, 22) are arranged vertically back to back with each other. Each ring-shaped piston (22, 22) includes, as shown in FIGS. 2 and 3, a ring-shaped piston portion (22*a*), a bearing portion (22*b*) and a piston-side end plate (22*c*). Each ring-shaped piston (22) is formed by connecting an end part of the piston portion (22*a*) and an end part of the bearing portion (22*b*) by the piston-side end plate (22*c*).

The piston portion (22*a*) is formed such that the surface area of the outer circumferential surface (first surface) (25) thereof is equalized to the surface area of the inner circumferential surface (second surface) (26) thereof. Specifically, the piston portion (22*a*) has a ring shape, and hence, the circumferential length (product of $2\pi$ and D1 of FIG. 3(B)) of the outer circumferential surface (25) is longer than the circumferential length (product of $2\pi$ and D2 of FIG. 3(B)) of the inner circumferential surface (26). Therefore, as shown in the enlarged view of FIG. 6, an axial height (H1) of the outer circumferential surface (25) of the piston portion (22*a*) is different from an axial height (H2) of the inner circumferential surface (26) thereof, and the axial height (H2) is higher than the axial height (H1). More specifically, the piston portion (22*a*) is formed such that the relation of (D1)×(H1)=(D2)×(H2) is satisfied.

Figure 6:
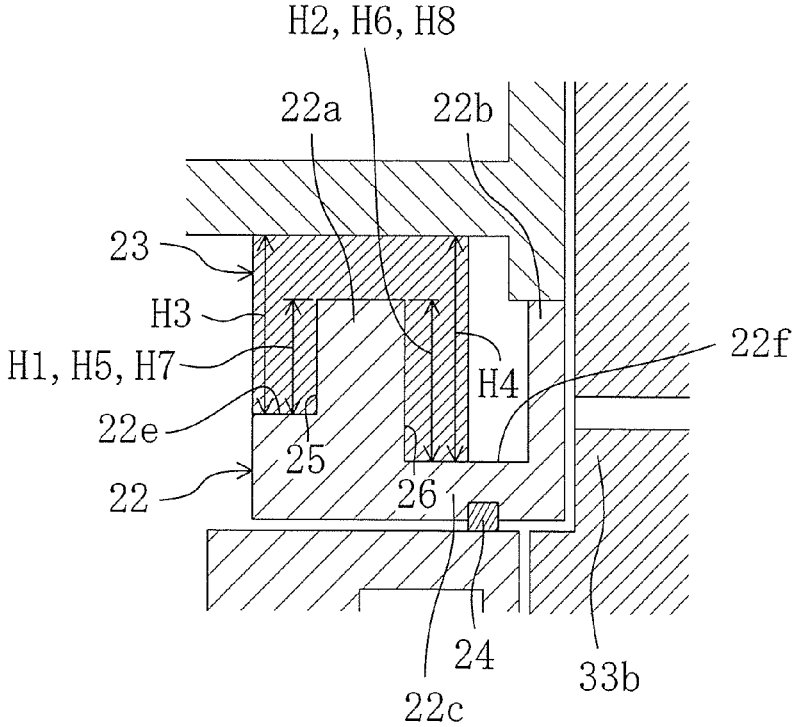
FIG. 6 is an enlarged longitudinal sectional view of the compression portion according to the first embodiment.

In other words, the end plate (22*c*) of each ring-shaped piston (22, 22) is formed such that an outside outer-circumferential bottom surface (22*e*) thereof located outward from the piston portion (22*a*) is shallower from the top of the piston portion (22*a*) seen in FIG. 6 than an inside bottom surface (22*f*) thereof located inward from the piston portion (22*a*).

The upper and lower ring-shaped pistons (22, 22) are fixed to the drive shaft (33) by fitting each bearing portion (22*b*) into the corresponding eccentric portion (33*b*, 63*b*) of the drive shaft (33). Here, as described earlier, the axial centers of the upper and lower eccentric portions (33*b*, 63*b*) are eccentric to the axial center of the drive shaft (33), and the eccentricity directions thereof mutually have an angle difference of 90 degrees. Therefore, the rotation axes of the upper and lower ring-shaped pistons (22, 22) fitted into the eccentric portions (33*b*, 63*b*) are eccentric to the axial center of the drive shaft (33), and the eccentricity directions thereof mutually have an angle difference of 90 degrees. As a result, a phase difference of 90 degrees in volume change is made between the compression chambers (C1, C2, C3, C4) of both compression portions (20).

The upper and lower piston-side end plates (22*c*) have a micro clearance between, and a seal ring (24) is provided in the micro clearance. The seal ring (24) partitions the micro clearance into an inner part and an outer part, and the inner part inward from the seal ring (24) leads to the high-pressure space (S2) through the oil supply passage (38) of the drive shaft (33). Here, a lubricating oil is supplied into the inner part from the oil supply passage (38) to thereby keep the micro clearance at a high pressure. Then, the pressure inside of the seal ring (24) forms a back pressure for pressing the upper ring-shaped piston (22) toward the upper cylinder (21) and pressing the lower ring-shaped piston (22) toward the lower cylinder (21).

Figure 5:
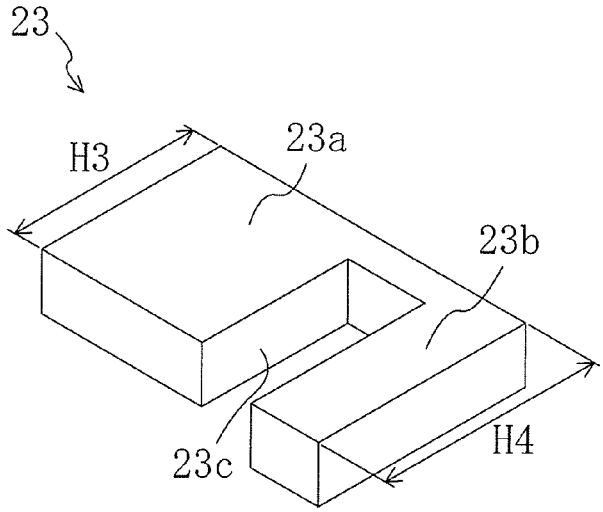
FIG. 5 is a perspective view of a blade according to the first embodiment.

The upper and lower blades (23) are each, as shown in FIGS. 2 and 5, a rectangular plate member including: an outside blade portion (23*a*) partitioning the outside compression chamber (C1, C3); an inside blade portion (23*b*) partitioning the inside compression chamber (C2, C4) united with the outside blade portion (23*a*); and a concave portion (23*c*) formed between the outside blade portion (23*a*) and the inside blade portion (23*b*). Each blade (23) is formed such that a height (H3) of the outside blade portion (23*a*) is lower than a height (H4) of the inside blade portion (23*b*).

In each compression portion (20, 20), the cylinder (21) and the ring-shaped piston (22) are each arranged as shown in FIG. 2. The piston portion (22*a*) of the ring-shaped piston (22) is undivided and continuously formed, and at a part of the piston portion (22*a*) in the circumferential directions, a straight portion (22*d*) is formed which is perpendicular to the radial directions extending along the central line of the blade (23).

On the other hand, in the outside cylinder portion (21*a*) and the inside cylinder portion (21*b*) of each cylinder (21, 21), the parts thereof corresponding to the straight portion (22*d*) of the piston portion (22*a*) are each formed with a straight portion (FIG. 4) perpendicular to the radial directions. The straight portions of both cylinder portions (21*a*, 21*b*) are each formed with a blade groove (28) which is fitted with the blade (23) fitted with the piston portion (22*a*) such that the blade (23) is slidable. The blade groove (28) is linearly and continuously formed along the radial directions of each cylinder (21, 21).

Then, each blade (23) is slidably fitted into the blade groove (28) while the concave portion (23*c*) is fitted with the straight portion (22*d*) of the piston portion (22*a*). Therefore, as described earlier, the outside blade portion (23*a*) partitions the outside compression chamber (C1, C3) into a high-pressure side (C1) and a low-pressure side (C3) and the inside blade portion (23*b*) partitions the inside compression chamber (C2, C4) into a high-pressure side (C2) and a low-pressure side (C4).

The outer circumferential surface of the inside cylinder portion (21*b*) and the inner circumferential surface of the outside cylinder portion (21*a*) are each formed by a cylindrical surface arranged concentrically with each other. Here, the inner circumferential surface of the outside cylinder portion (21*a*) is formed with a step (21*d*) having a smaller inner-circumferential diameter. Then, the ring-shaped compression chamber (C1, C2, C3, C4) as the compression chamber are formed between the inner circumferential surface having the smaller inner-circumferential diameter of the outside cylinder portion (21*a*) and the outer circumferential surface of the inside cylinder portion (21*b*).

Specifically, the inner circumferential part of the outside cylinder portion (21*a*) is formed with a concave portion (21*e*) for inserting the peripheral part of the end plate (22*c*) of each ring-shaped piston (22, 22). Then, the inner circumferential edge of the concave portion (21*e*) continues via the step (21*d*) to a bottom surface (21*f*) of the end plate (21*c*), and hence, the space between the step (21*d*) of the outside cylinder portion (21*a*) and the outer circumferential surface of the inside cylinder portion (21*b*) corresponds to the compression chamber (C1, C2, C3, C4).

Inside of the compression chamber (C1, C2, C3, C4) is arranged the piston portion (22*a*) of the ring-shaped piston (22). Specifically, the outer circumferential surface (25) of the piston portion (22*a*) has a smaller diameter than the step (21*d*) having the smaller inner-circumferential diameter of the outside cylinder portion (21*a*), while the inner circumferential surface (26) of the piston portion (22*a*) has a larger diameter than the outer circumferential surface of the inside cylinder portion (21*b*). Therefore, the outside compression chamber (C1, C3) is formed between the outer circumferential surface (25) of the piston portion (22*a*) and the step (21*d*) having the smaller inner-circumferential diameter of the outside cylinder portion (21*a*), while the inside compression chamber (C2, C4) is formed between the inner circumferential surface (26) of the piston portion (22*a*) and the outer circumferential surface of the inside cylinder portion (21*b*).

The surface area of the step (21*d*) as an inner circumferential surface of the outside cylinder portion (21*a*) and the surface area of the outer circumferential surface of the inside cylinder portion (21*b*) are equalized to each other such that these surfaces correspond to the outer circumferential surface (25) and the inner circumferential surface (26) of the piston portion (22*a*), respectively.

In each ring-shaped piston (22) and each cylinder (21), in a state where the outer circumferential surface (25) of the piston portion (22*a*) and the smaller-diameter inner circumferential surface of the outside cylinder portion (21*a*) are substantially in contact at one point with each other (strictly speaking, there is a micro clearance of a micron order, but in a state where the leakage of a refrigerant through the micro clearance is unproblematic), in a position where the phase is different by 180 degrees from the point of contact, the inner circumferential surface (26) of the piston portion (22*a*) and the outer circumferential surface of the inside cylinder portion (21*b*) are substantially in contact at one point with each other. According to this configuration, as the ring-shaped piston (22) rotates eccentrically, a phase difference of 180 degrees in volume change is made between the outside compression chamber (C1, C3) and the inside compression chamber (C2, C4).

Each cylinder (21) is formed with a suction port (41) penetrating the outside cylinder portion (21*a*) in a cylinder-radius direction. One open end of the suction port (41) faces on the low-pressure chamber (C1) of the outside compression chamber (C1, C3) while the other open end is provided with the suction pipe (14) inserted therein. Here, both suction ports (41) open toward the suction pipes (14) mutually in the same direction.

On the other hand, the piston portion (22*a*) is formed with a through hole (44) connecting the low-pressure chamber (C1) of the outside compression chamber (C1, C3) and the low-pressure chamber (C2) of the inside compression chamber (C2, C4).

In addition, each cylinder (21) is formed, as shown in FIG. 2, with an outside discharge port (45) and an inside discharge port (46) (omitted in FIG. 1) which penetrate the cylinder-side end plate (21*c*) in the thickness directions thereof. The open end of the outside discharge port (45) on the side of the ring-shaped piston (22) faces on the high-pressure chamber (C3) of the outside compression chamber (C1, C3), while the open end of the inside discharge port (46) on the side of the ring-shaped piston (22) faces on the high-pressure chamber (C4) of the inside compression chamber (C2, C4). The outside discharge port (45) and the inside discharge port (46) are each formed with a delivery valve (not shown) formed by a check valve which opens and closes each port.

As can be seen in FIG. 1, the front end surface (lower end surface in FIG. 1) of the upper inside cylinder portion (21*b*) slides in contact with the upper end surface of the upper piston-side end plate (22*c*), while the front end surface (upper end surface in FIG. 1) of the lower inside cylinder portion (21*b*) slides in contact with the lower end surface of the lower piston-side end plate (22*c*).

On the other hand, the front end surface (upper end surface in FIG. 1) of the upper piston portion (22*a*), except for the part thereof where the blade (23) is fitted thereinto, slides in contact with the upper surface of the compression chamber (C1, C2, C3, C4), while the front end surface (lower end surface in FIG. 1) of the lower piston portion (22*a*), except for the part thereof where the blade (23) is fitted thereinto, slides in contact with the lower surface of the compression chamber (C1, C2, C3, C4). Further, the upper surface of the upper blade (23) slides in contact with the lower end surface of the upper cylinder-side end plate (21*c*) while the lower surface of the lower blade (23) slides in contact with the upper end surface of the lower cylinder-side end plate (21*c*).

In addition, the front end surface (upper end surface in FIG. 1) of the upper bearing portion (22*b*) slides in contact with a flat plate part inside of the upper inside cylinder portion (21*b*), while the front end surface (lower end surface in FIG. 1) of the lower bearing portion (22*b*) slides in contact with a flat plate part inside of the lower inside cylinder portion (21*b*).

As described above, each part of the ring-shaped piston (22), each cylinder (21, 21) and the blade (23) mutually slides in contact to thereby keep the compression chamber (C1, C2, C3, C4) airtight.

(Operation)

Next, a description will be given about a compression operation of the compression mechanism (5) in the above rotary compressor (1). Here, the upper and lower compression portions (20, 20) operate with mutually shifted by 90 degrees. Except for the phases thereof, each of them conducts the same operation, and hence, the operation of the upper compression portion (20) will be typically described.

First, upon starting the electric motor (30), the rotor (32) rotates, and this rotation is transmitted via the drive shaft (33) to the ring-shaped piston (22) of the upper compression portion (20). Then, the piston portion (22*a*) of the ring-shaped piston (22) makes a reciprocating motion together with the blade (23) in the radial directions along the blade groove (28), and the straight portion (22*d*) of each ring-shaped piston (22) makes a reciprocating motion perpendicularly to the radial directions inside of the concave portion (23*c*) of the blade (23).

Here, the ring-shaped piston (22) slides perpendicularly to the blade (23) arranged in cylinder radial directions and moves together with the blade (23) only in the cylinder radial directions. Therefore, the ring-shaped piston (22) is restrained from being displaced in the rotational directions, and hence, the blade (23) configures a rotation prevention mechanism for restraining the ring-shaped piston (22, 22) from rotating on the axis thereof.

The above reciprocating motions in the radial directions and in the directions perpendicular to the radial directions are combined, and thereby, the piston portion (22*a*) revolves with respect to the outside cylinder portion (21*a*) and the inside cylinder portion (21*b*) of each cylinder (21), so that the compression portion (20) conducts a predetermined compression operation.

Figure 7:
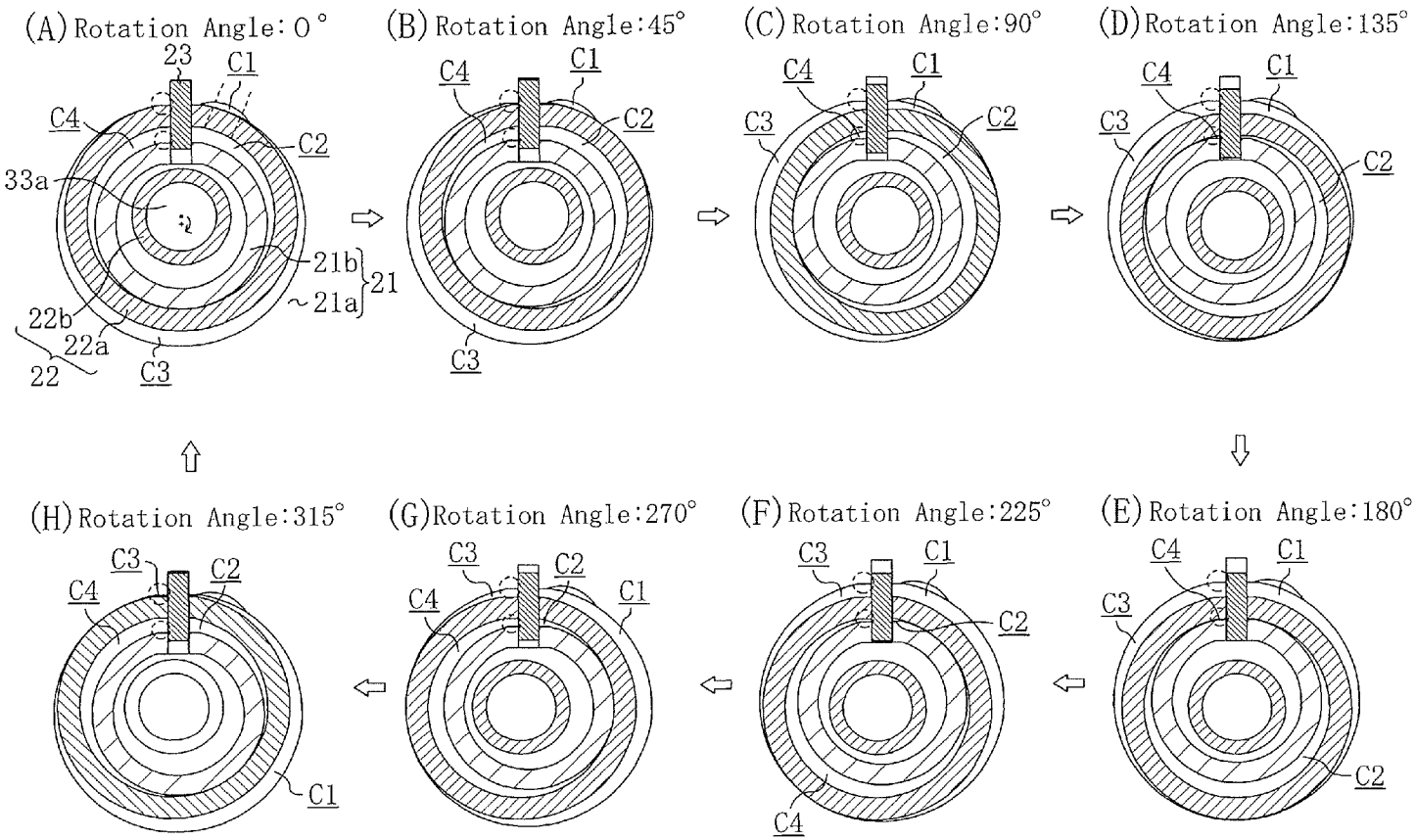
FIGS. 7(A) to 7(H) are transverse sectional views showing an operation of the compression portion.

Specifically, in the outside compression chamber (C1, C3), the volume of the low-pressure chamber (C1) is substantially at the minimum in the state of FIG. 7(B). From this state, the drive shaft (33) rotates clockwise in the figure, and as the state changes from FIG. 7(C) to FIG. 7(A), the volume of the low-pressure chamber (C1) increases and a refrigerant passes through the suction pipe (14) and the suction port (41) and is sucked into the low-pressure chamber (C1). The drive shaft (33) makes one rotation and the state comes to FIG. 7(B) again, and thereby, the suction of the refrigerant into the low-pressure chamber (C1) is completed.

This time, the low-pressure chamber (C1) becomes the high-pressure chamber (C3) for compressing the refrigerant and a new low-pressure chamber (C1) is formed on the other side of the blade (23). As the drive shaft (33) rotates further, the suction of the refrigerant is repeated in the low-pressure chamber (C1), while the volume of the high-pressure chamber (C3) decreases and the refrigerant is compressed in the high-pressure chamber (C3). When the pressure of the high-pressure chamber (C3) has become a predetermined value and the differential pressure between it and the discharge space has reached a set value, the high-pressure refrigerant of the high-pressure chamber (C3) opens the delivery valve and flows into the high-pressure space (S2) inside of the casing (10) from the discharge space.

On the other hand, in the inside compression chamber (C2, C4), the volume of the low-pressure chamber (C2) is substantially at the minimum in the state of FIG. 7(F). From this state, the drive shaft (33) rotates clockwise in the figure, and as the state changes from FIG. 7(G) to FIG. 7(E), the volume of the low-pressure chamber (C2) increases and the refrigerant passes through the suction pipe (14), the suction port (41) and the through hole (44), and is sucked into the low-pressure chamber (C2) of the inside compression chamber (C2, C4).

The drive shaft (33) makes one rotation and the state comes to FIG. 7(F) again, and thereby, the suction of the refrigerant into the low-pressure chamber (C2) is completed. This time, the low-pressure chamber (C2) becomes the high-pressure chamber (C4) for compressing the refrigerant and a new low-pressure chamber (C2) is formed on the other side of the blade (23). As the drive shaft (33) rotates further, the suction of the refrigerant is repeated in the low-pressure chamber (C2), while the volume of the high-pressure chamber (C4) decreases and the refrigerant is compressed in the high-pressure chamber (C4). When the pressure of the high-pressure chamber (C4) has become a predetermined value and the differential pressure between it and the discharge space has reached a set value, the high-pressure refrigerant of the high-pressure chamber (C4) opens the delivery valve and flows into the high-pressure space (S2) inside of the casing (10) from the discharge space.

The outside compression chamber (C1, C3) starts to discharge the refrigerant substantially in the timing of FIG. 7(E) while the inside compression chamber (C2, C4) starts to discharge the refrigerant substantially in the timing of FIG. 7(A). In other words, the outside compression chamber (C1, C3) is different by substantially 180 degrees in the discharge timing from the inside compression chamber (C2, C4).

Advantages of First Embodiment

According to the first embodiment, in the ring-shaped piston (22), the outer circumferential surface (25) and the inner circumferential surface (26) of the piston portion (22*a*) have the same surface area. Therefore, a load exerted on the ring-shaped piston (22) (a load working on the outer circumferential surface (25)) by the gas pressure inside of the outside compression chamber (C1, C3) can be equalized to a load exerted on the ring-shaped piston (22) (a load working on the inner circumferential surface (26)) by the gas pressure inside of the inside compression chamber (C2, C4).

Here, the output torque of the drive shaft (33) is determined by the load working on the ring-shaped piston (22). Accordingly, the load working on the outer circumferential surface (25) is equalized to the load working on the inner circumferential surface (26), and thereby, the variations in the output torque of the drive shaft (33) by each compression portion (20) can be equalized. Therefore, the rotary compressor (1) according to the first embodiment generates the variations in the output torque of the drive shaft (33) shown in FIG. 8.

Figure 8:
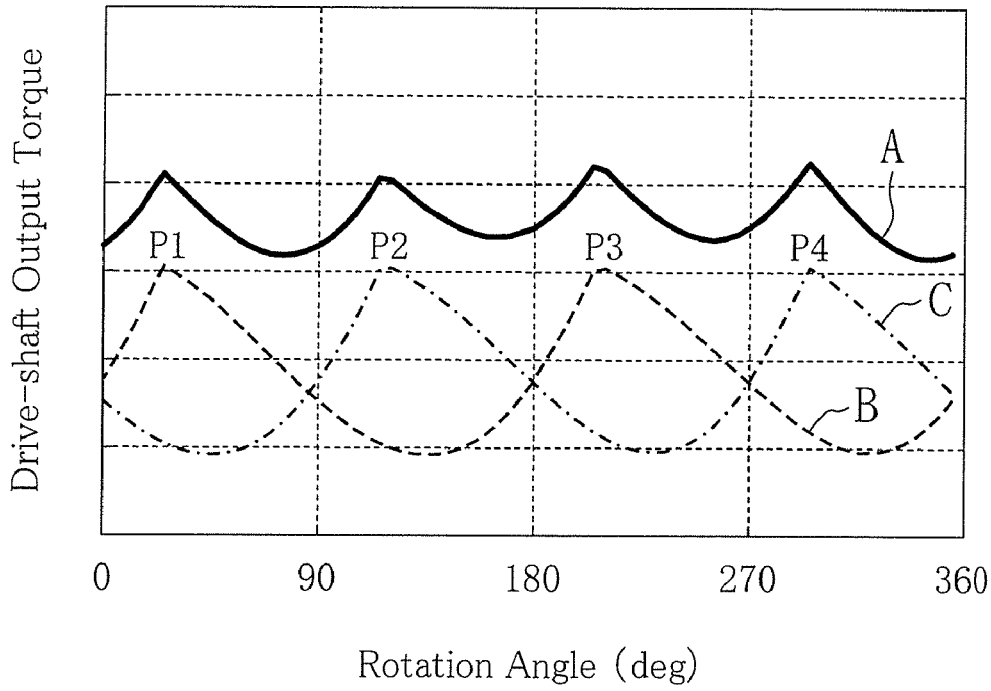
FIG. 8 is a graphical representation showing how a variation in the rotation angle of a drive shaft affects the output torque of the drive shaft in the rotary compressor according to the first embodiment.

FIG. 8 is a graphical representation showing how a variation in the rotation angle of a drive shaft affects the output torque of the drive shaft. In the figure, a line B indicates a variation in the output torque of the drive shaft in the case of only the upper compression portion (20), a line C indicates a variation in the output torque of the drive shaft in the case of only the lower compression portion (20) and a line A indicates a variation in the output torque of the drive shaft in the case where the upper and lower compression portions (20, 20) are joined together.

Figure 14:
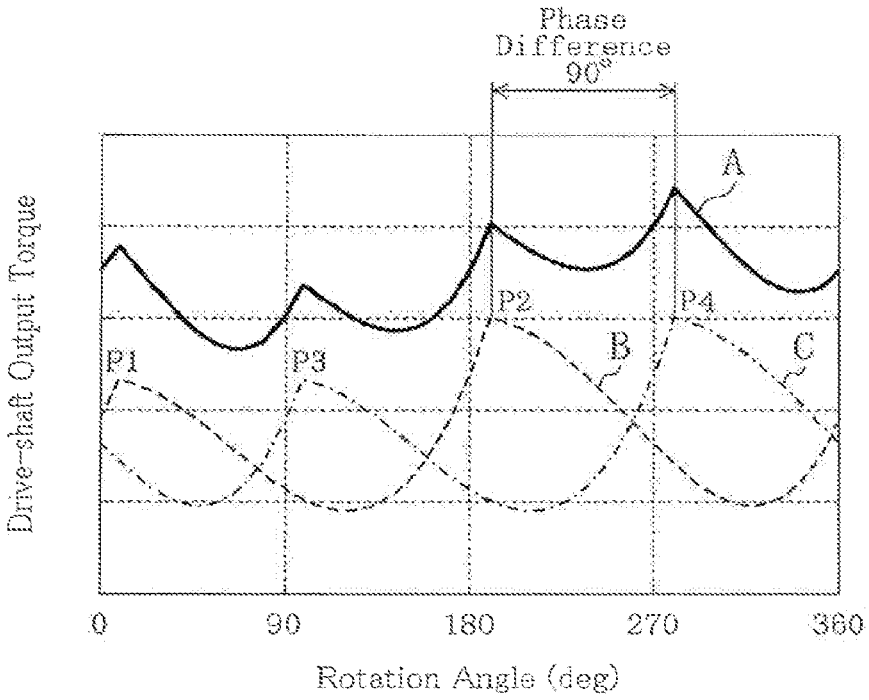
FIG. 14 (Prior Art)
FIG. 14 is a graphical representation showing how a variation in the rotation angle of a drive shaft affects the output torque of the drive shaft in the conventional rotary compressor.

As can be seen in FIG. 8, the peak values (P1, P2, P3, P4) of variations in the output torque by each compression portion (20) can be equalized. Therefore, the rotary compressor (1) according to the first embodiment is capable of making the variation in the output torque (the line A of FIG. 8) narrower than the variation in the output torque (the line A of FIG. 14) of the conventional rotary compressor. As a result, the vibration or noise of the rotary compressor (1) can be reduced.

In addition, according to the first embodiment, the blade (23) prevents the ring-shaped piston (22) from rotating on the axis thereof. Therefore, a member such as an Oldham coupling employed as a rotation prevention mechanism can be spared, thereby reducing the production cost of the rotary-type fluid machine.

Second Embodiment

Figure 9:
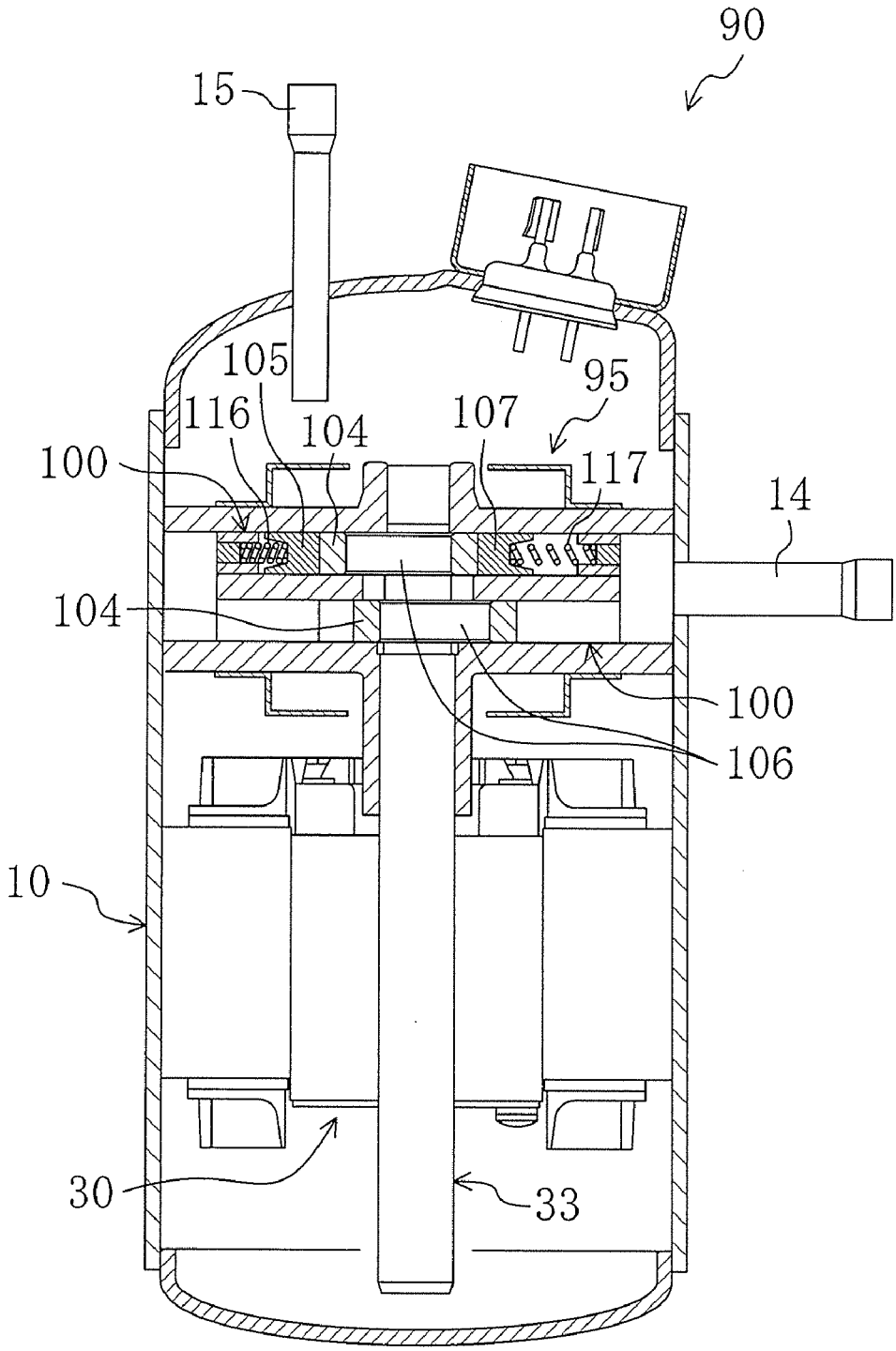
FIG. 9 is a longitudinal sectional view of a rotary compressor according to a second embodiment of the present invention.
Figure 10:
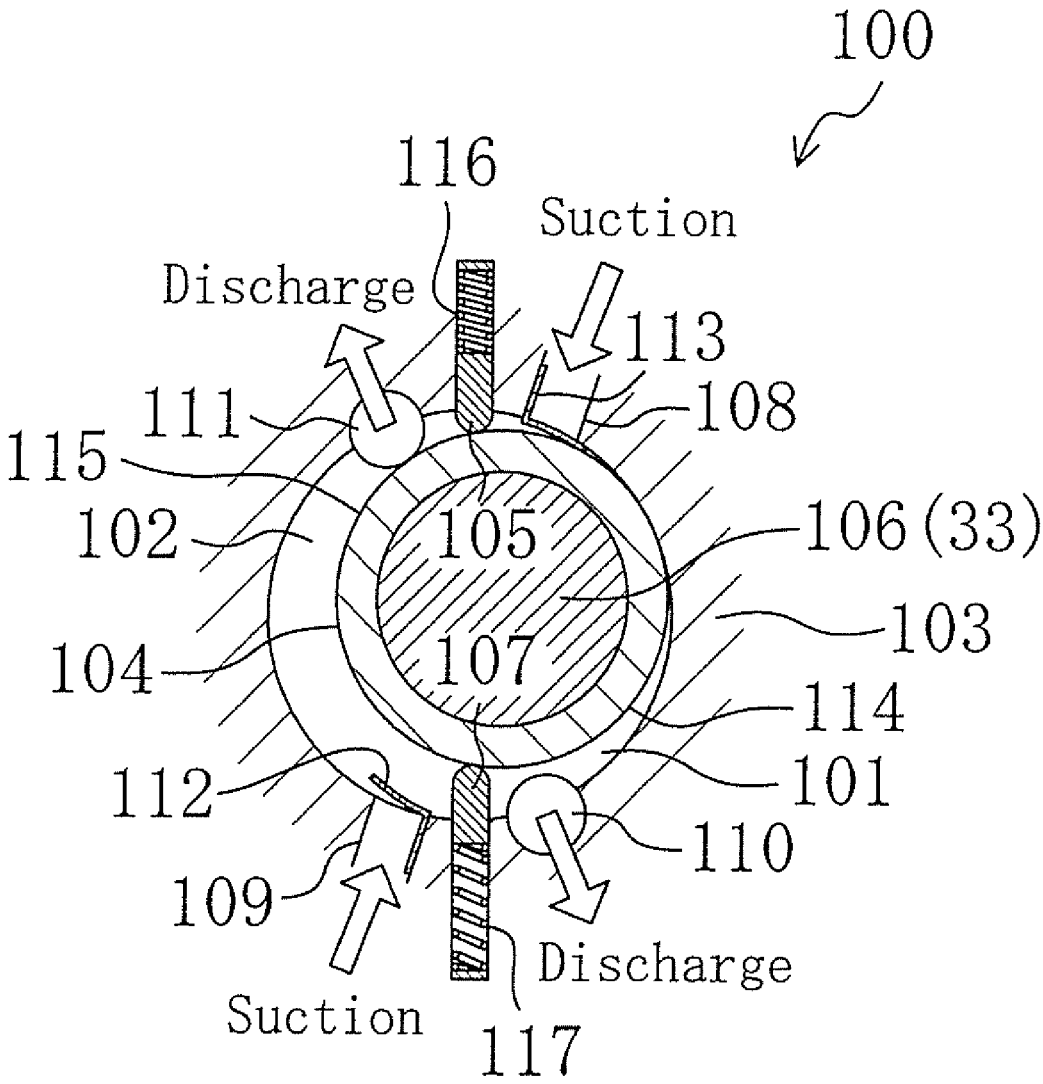
FIG. 10 is a transverse sectional view of a compression portion of the rotary compressor according to the second embodiment.
Figure 11:
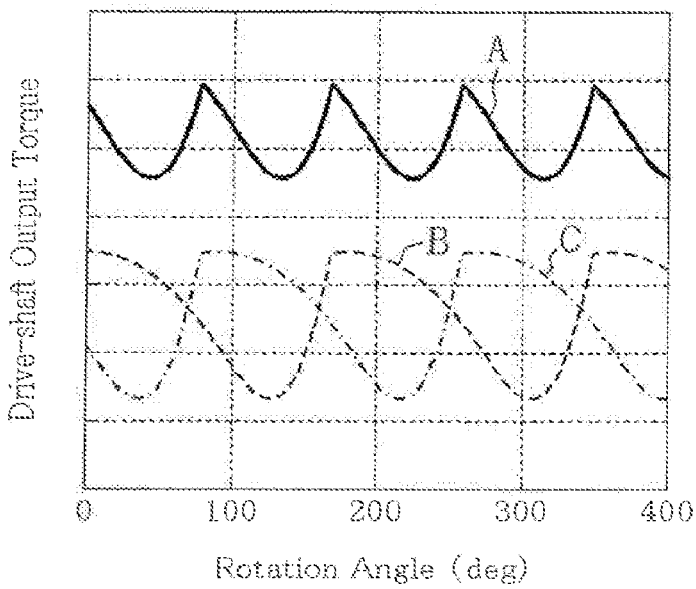
FIG. 11 is a graphical representation showing how a variation in the rotation angle of a drive shaft affects the output torque of the drive shaft in the rotary compressor according to the second embodiment.
Figure 12:
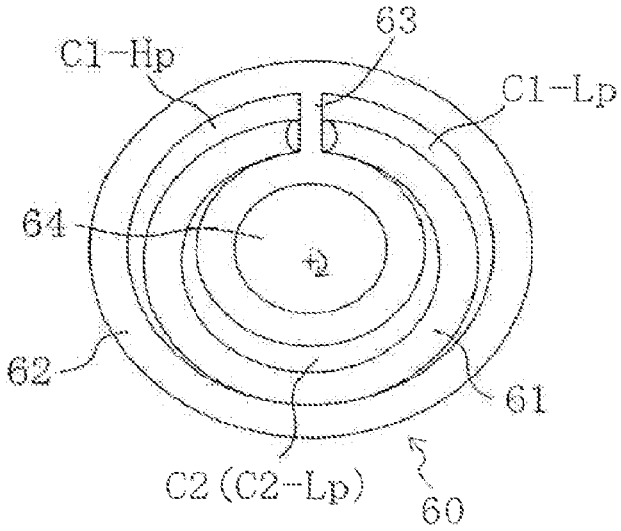
FIG. 12 (Prior Art)
FIG. 12 is a transverse sectional view of a compression portion of a conventional rotary compressor.
Figure 13:
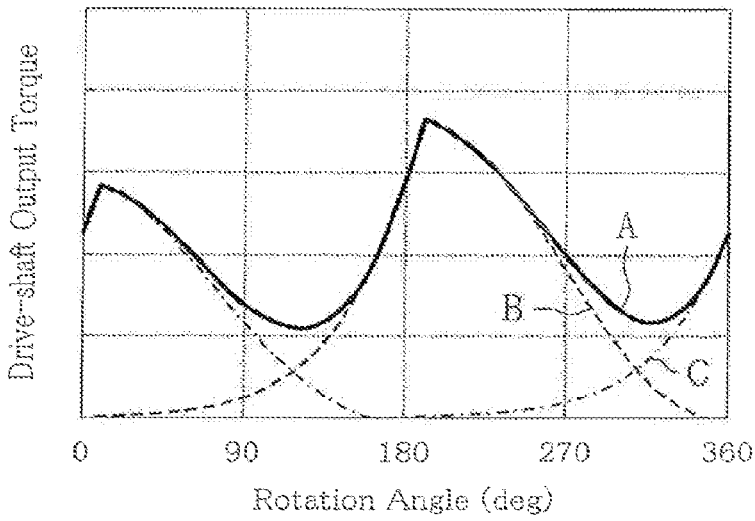
FIG. 13 (Prior Art)
FIG. 13 is a graphical representation showing how a variation in the rotation angle of a drive shaft affects the output torque of the drive shaft in the conventional rotary compressor.

FIG. 9 is a longitudinal sectional view of a rotary compressor (90) according to a second embodiment of the present invention and FIG. 10 is a transverse sectional view of each compression portion (eccentric-rotation type piston mechanism) (100) in a compression mechanism (95) of the rotary compressor (90). In FIG. 9, component elements are given the same reference characters and numerals as those of the rotary compressor (1) according to the first embodiment, as long as the former are identical to the latter. FIG. 11 is a graphical representation showing how a variation in the rotation angle of a drive shaft affects the output torque of the drive shaft in the rotary compressor according to the second embodiment. In the figure, a line B indicates a variation in the output torque of the drive shaft in the case of only the upper compression portion (100), a line C indicates a variation in the output torque of the drive shaft in the case of only the lower compression portion (100) and a line A indicates a variation in the output torque of the drive shaft in the case where the upper and lower compression portions (100, 100) are joined together.

In the rotary compressor (90) according to the second embodiment, the compression portion (100) is of a multi-vane type, which is different from the rotary compressor (1) according to the first embodiment. The rotary compressor (90) is also different from the first embodiment in the configuration for making a phase difference of 90 degrees in volume change between compression chambers (101, 102) of the vertically-arranged compression portions (100). Only those differences will be below described.

As shown in FIG. 10, the compression portion (100) includes: a cylinder (103) formed with a compression chamber (cylinder chamber) (101, 102); a piston (104) housed in the compression chamber (101, 102) such that the piston (104) is eccentric to the compression chamber (101, 102); and a first vane (105) and a second vane (107) partitioning the compression chamber (101, 102) into a first compression chamber (101) and a second compression chamber (102).

The vanes (105, 107) are attached to the cylinder (103) such that each of them is movable back and forth in the length direction thereof. The tip of each vane (105, 107) protrudes inward from the inner-circumferential wall surface of the cylinder (103) and comes into contact with and presses the outer-circumferential wall surface of the piston (104). Specifically, each vane (105, 107) is provided at the end thereof with a vane spring (116, 117), respectively, and the vane spring (116, 117) forces, onto the piston (104), the corresponding vane (105, 107) movable back and forth in the length direction. The force thereby keeps the tip of each vane (105, 107) constantly staying in contact with and pressing the outer-circumferential wall surface of the piston (104), even though the piston (104) makes an eccentric rotational motion.

Here, the vanes (105, 107) are attached to the cylinder (103) such that each of them comes into contact with and presses the outer-circumferential wall surface of the piston (104) in a position mutually shifted by 180 degrees around the drive shaft (33) as the center. Therefore, as the piston (104) makes an eccentric rotational motion, a phase difference of 180 degrees in volume change is made between the first compression chamber (101) and the second compression chamber (102).

The cylinder (103) is formed with a first suction port (108) and a first discharge port (110) leading to the first compression chamber (101), and the first suction port (108) is provided with a first suction valve (113). Further, the cylinder (103) is formed with a second suction port (109) and a second discharge port (111) leading to the second compression chamber (102), and the second suction port (109) is provided with a second suction valve (112).

The piston (104) is attached such that the axial center thereof is eccentric to the axial center of the drive shaft (33). In terms of the outer-circumferential wall surface of the piston (104), a right outer-circumferential wall surface (first surface) (114) facing on the first compression chamber (101) and a left outer-circumferential wall surface (second surface) (115) facing on the second compression chamber (102) have the same surface area. Specifically, the tip of each vane (105, 107) comes into contact with and presses the outer-circumferential wall surface of the piston (104) in a position mutually shifted by 180 degrees around the drive shaft (33) as the center, thereby equalizing the circumferential lengths of both outer-circumferential wall surfaces (114, 115). Then, both outer-circumferential wall surfaces (114, 115) have the same height in the axial directions to thereby equalize the surface areas of both outer-circumferential wall surfaces (114, 115). As shown in FIG. 9, the thus configured compression portions (100) are vertically adjacent to each other.

Here, the upper and lower pistons (104) are attached to eccentric portions (106) of the drive shaft (33) such that the eccentricity directions of the axial centers of both pistons (104) mutually have an angle of 180 degrees to the axial center of the drive shaft (33). Besides, the opening directions of the first and second suction ports (108, 109) in one of the above compression portions (100) are shifted by 90 degrees with respect to the opening directions of the first and second suction ports (108, 109) in the other compression portion (100), respectively. Then, the opening directions of the first and second discharge ports (110, 111) in the one compression portions (100) are shifted by 90 degrees with respect to the opening directions of the first and second discharge ports (110, 111) in the other compression portion (100), respectively.

According to this configuration, a phase difference of 90 degrees in volume change is made between the compression chambers (101, 102) of both compression portions (100).

According to the second embodiment, as the piston (104) rotates, the volume of each compression chamber (101, 102) increases and thereby a gas refrigerant is sucked into each compression chamber (101, 102), while the volume of each compression chamber (101, 102) decreases and thereby the sucked gas refrigerant is compressed and discharged from each compression chamber (101, 102). This operation is repeated, and thereby, the compression portions (100) conduct the compression operation for a gas refrigerant.

Advantages of Second Embodiment

According to the second embodiment, each compression portion (100) is of a multi-vane type. Therefore, as compared with the first embodiment, a load exerted on the piston (104) (a load working on the right outer-circumferential wall surface (114)) by the gas pressure inside of the first compression chamber (101) can be easily equalized to a load exerted on the piston (104) (a load working on the left outer-circumferential wall surface (115)) by the gas pressure inside of the second compression chamber (102).

Specifically, according to the first embodiment, the ring-shaped compression chambers (C1, C2, C3, C4) are formed on the inside and outside of the piston portion (22*a*), and thereby, the outer circumferential surface (25) and the inner circumferential surface (26) of the piston portion (22*a*) each have a mutually different length in the circumferential directions. Therefore, in order to equalize the gas pressures working on the outer circumferential surface (25) and the inner circumferential surface (26), the piston portion (22*a*) needs to be machined such that the outer circumferential surface (25) and the inner circumferential surface (26) each have a different height in the axial directions to thereby equalize the surface areas of the outer circumferential surface (25) and the inner circumferential surface (26).

However, according to the second embodiment, the compression chambers (101, 102) are formed on both sides of the piston (104), and the points at which the vanes (105, 107) come into contact with and press the outer-circumferential wall surface of the piston (104) are mutually shifted by 180 degrees around the drive shaft (33) as the center. Therefore, both outer-circumferential wall surfaces (114, 115) have the same circumferential length, so that the surface areas of the outer circumferential surface (25) and the inner circumferential surface (26) can be equalized without machining the piston (104) such that both outer-circumferential wall surfaces (114, 115) each have a different height in the axial directions. As described above, both loads exerted on the piston (104) can be more easily equalized than the first embodiment.

The thus configured compression portions (100) are vertically arranged, and thereby, as can be seen in FIG. 11, the rotary compressor according to the second embodiment is capable of making the variation in the output torque (the line A of FIG. 11) narrower than the variation in the output torque (the line A of FIG. 14) of the conventional compressor. As a result, the vibration or noise of the rotary compressor can be reduced.

Other Embodiments

The above embodiments may be configured as follows.

In the first embodiment, the ring-shaped piston (22) is formed as a moving member, but the present invention is not necessarily limited to this, and hence, the cylinder (21) may be formed as a moving member. In this case, the step (21*d*) having the smaller inner-circumferential diameter of the outside cylinder portion (21*a*) configures the first surface and the outer circumferential surface of the inside cylinder portion (21*b*) configures the second surface. Then, the surface area of the step (21*d*) of the outside cylinder portion (21*a*) is equalized to the surface area of the outer circumferential surface of the inside cylinder portion (21*b*).

Furthermore, in the first embodiment, in order to make a phase difference of 90 degrees in volume change between the compression chambers (C1, C2, C3, C4) of both compression portions (20), both eccentric portions (33*b*, 63*b*) are fixed to the drive shaft (33) such that the eccentricity direction of each eccentric portion (33*b*, 63*b*) mutually has an angle of 90 degrees. However, the present invention is not necessarily limited to this, and hence, the eccentricity directions may be mutually shifted by a predetermined angle. Here, a phase difference of 90 degrees in volume change between the compression chambers (C1, C2, C3, C4) of both compression portions (20) may not be made by only shifting each eccentricity direction by the predetermined angle. Therefore, if necessary, an adjustment needs to be made such that the opening direction of each suction port (41) mutually has a predetermined angle around the drive shaft (33) as the center, thereby making a phase difference of 90 degrees in volume change between the compression chambers (C1, C2, C3, C4).

For example, if a setting is given such that the eccentricity directions of the eccentric portions (33*b*, 63*b*) mutually have an angle of 180 degrees, then the opening direction of each suction port (41) is mutually shifted by an angle of 90 degrees, and thereby, a phase difference of 90 degrees in volume change can be made between the compression chambers (C1, C2, C3, C4) of both compression portions (20). As a result, an improvement can be made in the balance of a centrifugal force working on the rotary compressor (1) by the rotation of the drive shaft (33).

In contrast, in the second embodiment, the eccentric portions (106, 106) are fixed to the drive shaft (33) such that the eccentricity direction of each eccentric portion (106, 106) mutually has an angle of 180 degrees. Besides, the opening directions of the first and second suction ports (108, 109) in one of the compression portions (100) are shifted by 90 degrees with respect to the opening directions of the first and second suction ports (108, 109) in the other compression portion (100), respectively. Then, the opening directions of the first and second discharge ports (110, 111) in the one compression portions (100) are shifted by 90 degrees with respect to the opening directions of the first and second discharge ports (110, 111) in the other compression portion (100), respectively.

However, the present invention is not necessarily limited to this, and for example, each eccentric portion (106, 106) may be fixed to the drive shaft (33) such that the eccentricity direction thereof mutually has an angle of 90 degrees. In this case, the opening directions of the first and second suction ports (108, 109) in the one compression portion (100) are set to the same as the opening directions of the first and second suction ports (108, 109) in the other compression portion (100), respectively. Then, the opening directions of the first and second discharge ports (110, 111) in the one compression portions (100) are set to the same as the opening directions of the first and second discharge ports (110, 111) in the other compression portion (100), respectively.

The aforementioned embodiments are essentially preferred illustrations, and hence, the scope of the present invention, the one applied thereto or the use thereof is not supposed to be limited.

INDUSTRIAL APPLICABILITY

As described hereinbefore, the present invention is useful for a rotary-type fluid machine, and particularly to a rotary-type fluid machine including two eccentric-rotation type piston mechanisms arranged one on top of the other, the eccentric-rotation type piston mechanisms each having a cylinder formed with a cylinder chamber and a piston housed eccentrically in the cylinder chamber.

What is claimed is:

1. A rotary-type fluid machine, comprising:

a compression mechanism including two eccentric-rotation type piston mechanisms arranged one on top of the other; and a drive mechanism including a drive shaft that is configured and arranged to drive the two eccentric-rotation type piston mechanisms, each of the two eccentric-rotation type piston mechanisms including a cylinder member formed with a cylinder chamber, a piston member housed eccentrically in the cylinder chamber such that the cylinder chamber is partitioned into a first cylinder chamber and a second cylinder chamber, and a blade member partitioning each of the first cylinder chamber and the second cylinder chamber into a high-pressure side and a low-pressure side, with one of the cylinder member and the piston member being formed as a fixed member and the other being formed as a moving member configured to make eccentric rotational motion relative to the fixed member, and the moving member, the fixed member and the blade being configured and arranged such that as the moving member makes the eccentric rotational motion, a phase difference of 180 degrees in volume change is made between the first cylinder chamber and the second cylinder chamber, the moving members, the fixed members and the blades being further configured and arranged such that a phase difference of 90 degrees in volume change is made between the cylinder chambers of the two eccentric-rotation type piston mechanisms, and each of the two moving members having a first surface facing one of the first cylinder chambers and a second surface facing one of the second cylinder chambers, with a surface area of the first surface being equal to a surface area of the second surface.

2. The rotary-type fluid machine of claim 1, wherein each of the two cylinder chambers has a ring shape;

each of the two the piston members is formed by a ring-shaped piston housed eccentrically in one of the ring-shaped cylinder chambers such that the cylinder chamber is partitioned into an outside cylinder chamber and an inside cylinder chamber; and each of the two first cylinder chambers is formed by one of the outside cylinder chambers and each of the two second cylinder chambers is formed by one of the inside cylinder chambers.

3. The rotary-type fluid machine of claim 2, wherein each of the two ring-shaped pistons is formed with a straight portion arranged at a circumferential part thereof extending in circumferential directions and continuing to other parts thereof;

each of the two cylinder members is formed with a groove portion perpendicular to the straight portion received therein and extending across the outside cylinder chamber and the inside cylinder chamber thereof; and each of the two blade members includes an outside blade portion partitioning one of the outside cylinder chambers, an inside blade portion united with the outside blade portion and partitioning one of the inside cylinder chambers, and a concave portion formed between the outside blade portion and the inside blade portion and fitted slidably with the straight portion of one of the ring-shaped pistons by being fitted slidably into the groove portion of one of the cylinder members.

4. A rotary-type fluid machine, comprising:

a compression mechanism including two eccentric-rotation type piston mechanisms arranged one on top of the other; and a drive mechanism including a drive shaft that is configured and arranged to drive both eccentric-rotation type piston mechanisms, each of the two eccentric-rotation type piston mechanisms including a cylinder formed with a cylinder chamber and having the drive shaft penetrating a central part thereof, a piston housed in the cylinder chamber such that the piston is eccentric to the cylinder chamber, and two vanes partitioning the cylinder chamber into a first cylinder chamber and a second cylinder chamber, the piston being configured and arranged to make eccentric rotational motion relative to the cylinder, eccentricity directions of the pistons having an angle of 180 degrees therebetween around an axial center of the drive shaft, the two vanes each of the two eccentric-rotation type piston mechanisms being arranged in positions shifted by 180 degrees from each other around the axial center of the drive shaft, and opening directions of two suction ports in one of the eccentric-rotation type piston mechanisms being shifted by 90 degrees with respect to opening directions of two suction ports in the other eccentric-rotation type piston mechanism, respectively, and opening directions of two discharge ports in the one compression eccentric-rotation type piston mechanism being shifted by 90 degrees with respect to opening directions of two discharge ports in the other eccentric-rotation type piston mechanism, respectively.

* * * * *